United States Patent [19]

Ikegami

[11] 4,274,152

[45] Jun. 16, 1981

[54] SETTING MECHANISM OF A WATCH

[75] Inventor: Toshimasa Ikegami, Suwa, Japan

[73] Assignee: Kabushiki Kaisha Suwa Seikosha, Tokyo, Japan

[21] Appl. No.: 31,689

[22] Filed: Apr. 19, 1979

[30] Foreign Application Priority Data

Apr. 19, 1978 [JP] Japan ..... 53-51653[U]

[51] Int. Cl.[3] ..... G04B 27/04; G04B 19/24; G04B 29/00; G04B 19/20

[52] U.S. Cl. ..... 368/192; 368/191; 368/36; 368/319

[58] Field of Search ..... 58/63, 65, 90 B, 88 B, 58/85.5, 59, 73; 368/191–195, 36, 319

[56] References Cited

U.S. PATENT DOCUMENTS

| | | | |
|---|---|---|---|
| 3,319,415 | 5/1967 | Aesch et al. | 58/63 |
| 3,609,955 | 10/1971 | Suzuki | 58/4 |
| 3,690,061 | 9/1972 | Humbert et al. | 58/63 |
| 4,015,421 | 4/1977 | Mürrle | 58/86 |

*Primary Examiner*—J. V. Truhe
*Assistant Examiner*—John B. Conklin
*Attorney, Agent, or Firm*—Blum, Kaplan, Friedman, Silberman and Beran

[57] ABSTRACT

The setting mechanism of a watch includes a winding stem and a clutch wheel which can be moved selectively either rotationally or axially by said winding stem for control of one or more setting levers or wheels. The setting levers or wheels are disposed on the opposite side of said winding stem from the dial plate of the watch, thereby making it possible to center the winding stem in the thickness direction of the watch and to reduce the over-all thickness of the watch.

19 Claims, 6 Drawing Figures

SETTING MECHANISM OF A WATCH

BACKGROUND OF THE INVENTION

In the watch art it is generally considered that the winding stem, which may also be termed control stem or crown, should be positioned as closely as possible to the plane which is at the center of the watch in the thickness direction. With such an arrangement, the thickness of the watch can be minimized, and this is particularly desirable with respect to wristwatches, whether of the mechanical or the quartz crystal type. Now that quartz crystal wristwatches have developed to the point where watches with a plurality of functions have become common, a demand has arisen for wristwatches which are fashionable with respect to external appearance, a decrease in thickness being regarded as particularly important.

Conventional wristwatches in which an attempt has been made in the design thereof to minimize thickness generally have the crown positioned on the side of the back cover, an arrangement which is far from the above-mentioned ideal. The setting mechanism of the present invention is designed to meet this objective, that is, a thin and fashionable wristwatch, and more specifically, a quartz crystal wristwatch having no calendar mechanism.

SUMMARY OF THE INVENTION

The setting mechanism of a wristwatch in accordance with the present invention has a winding stem which can be engaged with a clutch wheel for transmitting both axial and rotational movement thereto and thence to a setting lever and a setting wheel. The setting lever and setting wheel are disposed on the opposite side of the winding stem from the dial plate of the watch.

In a first embodiment of the invention, the winding stem comprises a base portion, a connecting portion and a pin portion. A clutch wheel rides on said pin portion and has a socket therein for receiving the connecting portion, the socket and connecting portion mating for conjoint rotation. The clutch wheel has an engaging portion for engagement with a clutch lever and a gear for engaging a time-setting wheel. The base portion has therein a groove which engages a setting lever. The setting lever, the clutch lever and the setting wheel are all mounted on the opposite side of the winding stem from the dial plate of the watch. Axial translation of the winding stem can also be used to control a second-setting lever.

The clutch lever rides in a circular groove formed around the outer periphery of the clutch wheel. This groove is the engaging portion of the clutch wheel. The axially extended socket within the clutch wheel does not extend to the region of the peripheral groove. Thus, for example, any transverse section of the clutch wheel will not intersect both the socket and the peripheral groove. For this reason the groove can be cut more deeply into the clutch wheel in this embodiment than in the prior art (FIG. 1). Accordingly, the outside diameter of the clutch wheel is reduced and still retains sufficient groove depth to properly seat the clutch lever. With the clutch wheel reduced in diameter, and the setting lever, clutch lever and setting wheel positioned opposite the stem in relation to the dial plate, the stem centerline is moved closer to the dial plate and a thinner and more symmetrical timepiece is provided as compared to the prior art. The groove depth substantially corresponds to the effective inside diameter of the socket in the clutch wheel as seen in FIGS. 2, 3*a*, 3*b* and 4*a*.

In a second embodiment, the winding stem comprises a base portion and a connecting portion, the connecting portion having an axially directed socket therein. A pin which is coaxial with the winding stem is mounted in the main plate of the watch, one end of the pin being received in the connecting-portion socket. A clutch wheel grooved for engaging a clutch lever is supported on the pin. The clutch-wheel socket is shaped for mating with the connecting portion of the winding stem, as in the first embodiment, and has a gear at one end thereof for mating with a setting wheel. The setting wheel, the clutch lever and a setting lever which engages with a groove on the base portion are disposed on the opposite side of the winding stem from the dial plate of the watch. In this second embodiment of the invention, the pin is fixed in the main plate against either rotation or axial translation.

In a third embodiment of the invention, the construction is similar to that of the second embodiment except that the pin is mounted for rotation in the main plate and has a surface at the portion thereof which enters the connecting-portion socket for mating with the surface of said socket and being rotated thereby. Also, the end of the pin which is seated in the main plate has a gear at the end thereof which serves to engage and control a second-setting lever.

In a fourth embodiment of the invention, the winding stem has a base portion and a connecting portion, and the clutch wheel has a blind socket for mating with said connecting portion. The clutch wheel is supported by an auxiliary plate which has a shoulder which is traversed by the clutch wheel as it is moved axially. To facilitate axial translation of the clutch wheel and the gear at the end thereof, the shoulder is cut at an angle of at least 30 degrees to a plane perpendicular to the axis of the winding stem. A setting lever, controlled by a groove in the base portion, a clutch lever, controlled by a groove in the clutch wheel, and a setting wheel, controlled by the gear at the end of the clutch wheel, are all disposed on the opposite side of the winding stem from the dial plate of the watch.

Accordingly, an object of the present invention is a watch in which the position of the winding stem is as close as possible to the dial plate of the watch.

Another object of the present invention is an arrangement of a winding stem, a dial plate and elements and members controlled by the winding stem so as to minimize the thickness of said watch.

A further object of the present invention is the provision of support for a slidable wheel, such as a clutch wheel, which is essentially coaxial with an external operating member such as a winding stem wherein said wheel can move on the shaft of the external operating member.

An important object of the present invention is a winding stem having a tip which can engage with a member of a watch for regulating or resetting same.

A significant object of the present invention is a setting mechanism for a watch wherein said functions can be controlled, regulated and set while holding the thickness of the watch to a minimum.

Still other objects and advantages of the invention will in part be obvious and will in part be apparent from the specification.

The invention accordingly comprises the features of construction, combinations of elements, and arrangement of parts which will be exemplified in the constructions hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DESCRIPTION OF THE PREFERRED EMBODIMENTS

Figure 1:
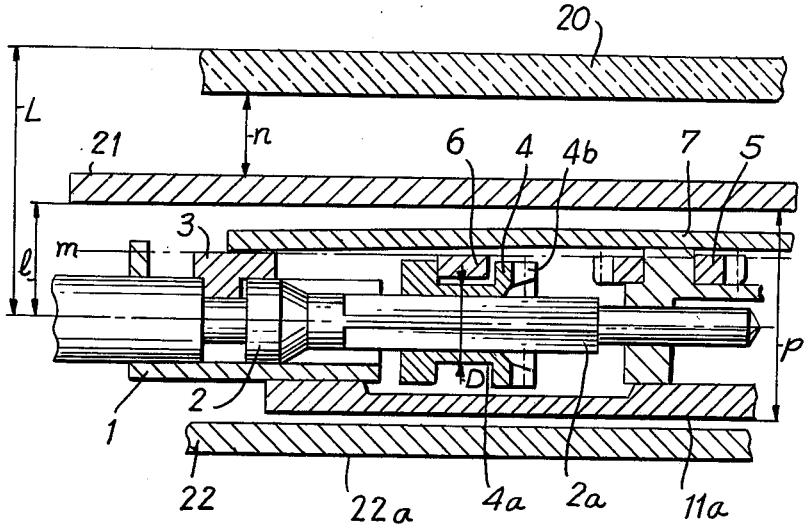
FIG. 1 PRIOR ART
FIG. 1 is a cross-sectional view of a setting mechanism using a conventional clutch wheel.

A setting mechanism in accordance with the prior art is shown in FIG. 1, said setting mechanism using a conventional clutch wheel. In FIG. 1, main plate 1 supports winding stem 2, winding stem 2 having a groove therein which engages setting lever 3. Clutch wheel 4 is supported on winding stem 2 and has at one end thereof a gear 4*b* for driving setting wheel 5 when clutch wheel 4 is moved toward setting wheel 5 by the action of winding stem 2. Clutch lever 6 is engaged by groove 4*a* in clutch wheel 4 and setting lever 3 is held in position by setting lever spring 7.

A significant feature of the construction of FIG. 1 is the length 1 between the lower surface of dial 20 and the axis of winding stem 2. In the construction of FIG. 1, setting lever 3, setting wheel 5, clutch lever 6 and setting lever spring 7 are all disposed on the same side of winding stem 2 as is dial plate 21. Moreover, engaging portion 2*a* of winding stem 2 is arranged and constructed for entering the shaft portion of clutch wheel 4, which has a peripheral surface including a groove 4*a* for engaging clutch lever 6. Accordingly, engaging portion 2*a* traverses the portion of the clutch wheel 4 having the diameter D.

Accordingly, taking into account the thickness of the above-mentioned watch parts, the interrelation between said parts and the space available in the direction perpendicular to the plane surface of main plate 1 required for disassembling the winding stem, length 1 must be from about 1 to 1.1 mm. Accordingly then, assuming that the thickness of glass 20 is 0.8 mm, that the space n for mounting the hands between the lower surface of the glass and the upper surface of the dial is 1 mm, the thickness of dial 21 is 0.3 mm, the thickness p of the movement is 2.4 mm, and the thickness between the surface 11*a* of the movement which is nearest to the back case and the lower surface 22*a* of back case 22 is 0.5 mm, the thickness of the watch is 5 mm, and the length L from the upper surface of the glass to the axis of the winding stem is 3.2 mm. Accordingly, the crown or winding stem is positioned toward the back of the case by a distance of 0.7 mm from the central plane m of the watch. This unsymmetrical disposal of the setting mechanism is a disadvantage which is eliminated by the construction taught herein. Specifically, the present invention provides a setting mechanism which is suitable for a thin wristwatch and which utilizes a wheel which is coaxial with the shaft of the winding stem and which is slidably translatable in the axial direction of the winding stem. Furthermore, the slidably moving wheel has an interior portion or socket which is shaped for receiving a connecting portion of the winding stem, the socket having a depth such that the connecting portion of the winding stem does not enter the portion of the wheel which has a periphery including a groove for engaging a clutch lever. Embodiments of the invention which include the above construction will be described in connection with the drawings.

Figure 2:
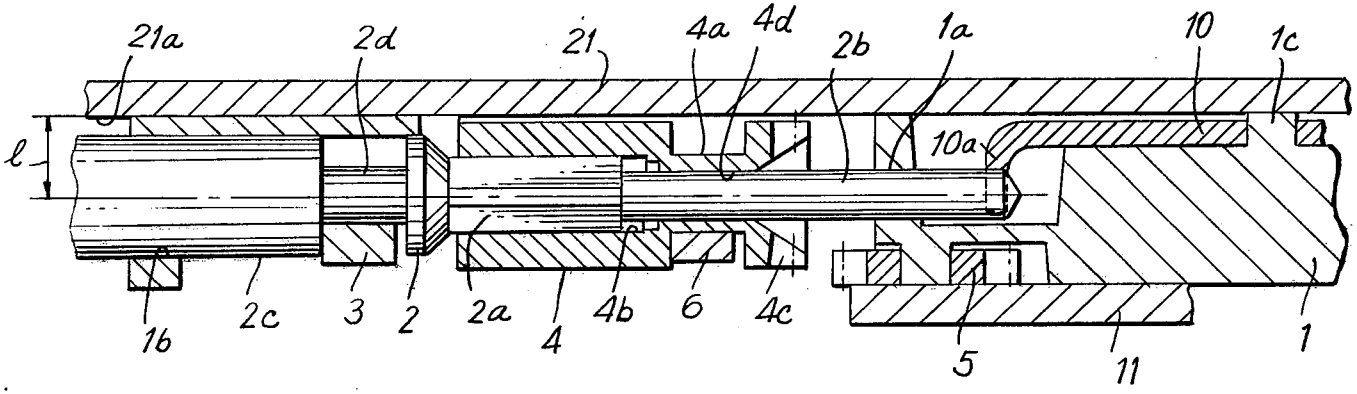
FIG. 2 is a cross-sectional view of a setting mechanism in accordance with a first embodiment of the invention.

In the embodiment shown in longitudinal cross-section in FIG. 2, winding stem 2 is made up of a connecting portion 2*a* having four plane surfaces, a pin portion 2*b* and a base portion 2*c*. Base portion 2*c* has a groove 2*d* about same for engaging with setting lever 3. It should be noted that connecting portion 2*a* need have only one plane surface provided that the interior of socket 4*b* of clutch wheel 4 is appropriately shaped to mate therewith. In fact, so long as the surface of connecting portion 2*a* is noncircular in transverse section and socket 4*b* is correspondingly shaped, connecting portion 2*a* can engage clutch wheel 4 for bringing same into rotation by rotation of winding stem 2. Winding stem 2 is supported both for rotation and for axial translation in openings 1*a* and 1*b* of main plate 1. Clutch wheel 4, in addition to socket 4*b* and groove 4*a*, includes a toothed end 4*c* and a support portion 4*d* which rides on pin portion 2*b* of winding stem 2. Clutch lever 6 is moved in either axial direction by the side walls of engaging groove 4*a* of clutch wheel 4 in response to axial movement of crown 2. Toothed end 4*c* engages with setting wheel 5 on movement of winding stem 2 to the right as shown in FIG. 2 for setting a hand.

Support portion 4*d* always rides upon tip portion 2*b* of the winding stem and has a diameter which is smaller than the diameter of a circle which is tangent to the four plane surfaces of the connecting portion 2*a* of the crown. Where the connecting portion has only one plane surface, the diameter of such a circle is obtained by doubling the shortest length between the axis of the crown shaft and the plane surface. The interior diameter of the clutch wheel at the support portion 4*d* should be as small as possible and yet provide for free movement of the clutch wheel 4 over the surface of pin portion 2*b*. This provides for precise control in the amount of engagement of clutch wheel 4 with setting wheel 5. A particularly significant feature of the embodiment taught herein and exemplified in FIG. 2 is that the setting lever 3 which engages with groove 2*d* of crown 2, clutch lever 6 which engages with setting lever 3 and the groove 4*a* of clutch wheel 4, and the setting wheel 5 for setting a hand by means of a gear train for the date display (not shown) are all disposed on the opposite side of the winding stem shaft from dial plate 21. This feature is of paramount importance in making it possible for the crown to be symmetrically located with respect to the thickness of the watch.

A second-setting lever 10 has an arm 10*a* at an angle with the remainder of same, said arm engaging the end section of pin portion 2*b* of winding stem 2. This second-setting lever 10 oscillates about pin 1*c* and sets at least one toothed wheel (not shown) at the time of hand-setting only. It is disposed on the side of the main plate toward the dial with respect to the winding stem, and its shape is determined by dial 21.

The clutch lever 6 (FIG. 2) rides in a circular groove 4*a* formed around the outer periphery of the clutch wheel 4. This groove 4*a* is the engaging portion of the clutch wheel 4. The axially extended socket 4*b* within the clutch wheel 4 does not extend to the region of the peripheral groove 4*a*. Thus, for example, any transverse section of the clutch wheel 4 will not intersect both the socket 4*b* and the peripheral groove 4*a*. For this reason the groove 4*a* can be cut more deeply into the clutch wheel 4 in this embodiment than in the prior art (FIG. 1). Accordingly, the maximum outside diameter of the clutch wheel 4 is reduced and still retains sufficient groove depth to properly seat the clutch lever 6. With the clutch wheel 4 reduced in diameter, the setting lever 3, clutch lever 6 and setting wheel 5 positioned opposite the stem 2 in relation to the dial plate 21, the stem centerline is moved closer to the dial plate 21 and a thinner and more symmetrical timepiece is provided as compared to the prior art. These are especially attractive features for an electronic timepiece. The groove depth substantially corresponds to the effective diameter of the socket 4*b* in the clutch wheel 4 as seen in FIG. 2 and also in FIGS. 3*a*, 3*b* and 4*a* which are described more fully hereinafter.

Figure 3A:
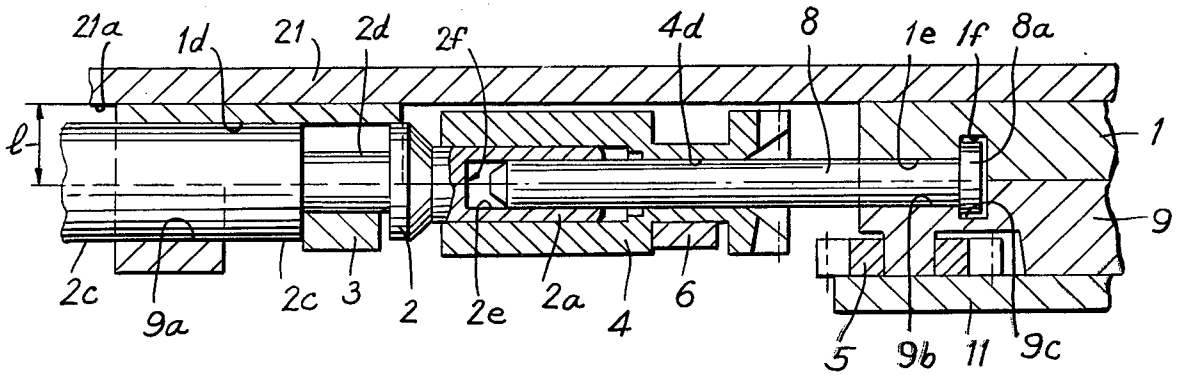
FIG. 3*a* is a cross-sectional view of a setting mechanism in accordance with a second embodiment of the present invention.

A second embodiment of the setting mechanism in accordance with the present invention is shown in longitudinal cross-sectional view in FIG. 3*a*. Main plate 1 has therein a half-annular groove 1*d* for rotatably supporting winding stem 2 and a half-annular groove 1*e* for rotatably supporting a shaft 8, shaft 8 and winding stem 2 being coaxial. Main plate 1 also has a half-annular groove 1*f* which engages with a flange portion 8*a* of shaft 8. Half-annular grooves 1*d* and 1*e* are actually hollow half-cylinders and each of the grooves may be described as a single-U. Plate 9, which is fixed to main plate 1 by screws, welding or the like (not shown), also has matching half-annular grooves 9*a*, 9*b* and 9*c* opposite, respectively, to grooves 1*d*, 1*e* and 1*f*.

Winding stem 2 is made up of an engaging portion 2*a* and a base portion 2*c*. Engaging portion 2*a* has an interior socket 2*e* which engages with shaft 8, and base portion 2*c* has a peripheral groove about same, the walls of said groove engaging with setting lever 3. Base portion 2*c* of winding stem 2 is supported both for rotation and axial translation in the single-U grooves 1*d* and 9*a* of plates 1 and 9. The inner end of engaging portion 2*a* of the winding stem 2 is rotatably supported by shaft 8, clutch wheel 4 also being rotatably and axially supported on shaft 8 at support portion 4*d* thereof. This arrangement facilitates disassembly of the winding stem, as well as facilitating the insertion of the winding stem at the time of mounting same. Shaft 8 is supported parallel to the plane surface of main plate 1 and coaxially with winding stem 2 by means of the half-cylindrical grooves 1*e* and 9*b* in plates 1 and 9. The shaft is prevented from axial movement when the winding stem 2 is pulled outwardly, such movement being prevented by the walls of grooves 1*f* and 9*c*, which are formed about flange portion 8*a* of shaft 8.

Clutch wheel 4 and winding stem 2 are always rotatably supported by shaft 8, but it may be desirable to rotatably support only clutch wheel 4. In the embodiment of FIG. 3*a*, shaft 8 is fixed against rotation by bonding to one or both of plates 1 and 9, such bonding being effected by friction, welding or the like.

Figure 3B:
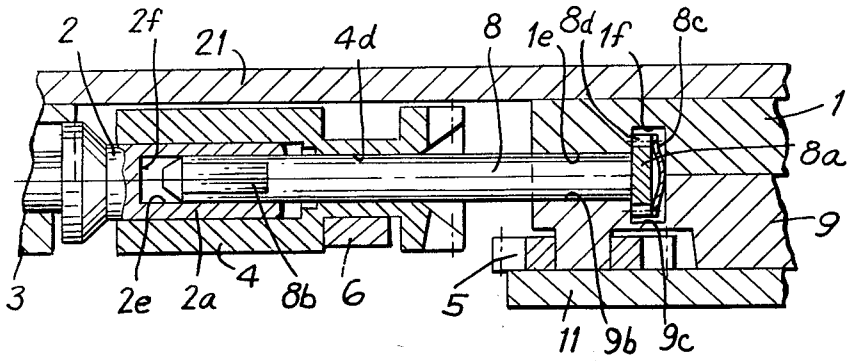
FIG. 3*b* is a cross-sectional view of a setting mechanism in accordance with a third embodiment of the present invention.

In the embodiment of FIG. 3*b*, a construction similar to that of FIG. 3*a* is shown, the principal difference being that shaft 8 is rotatable. To bring shaft 8 into rotation, said shaft has at least one flat surface 8*b* thereon, and the interior of socket 2*e* is shaped for mating therewith for bringing shaft 8 into rotation when winding stem 2 is rotated. Also, flange 8*a* is provided with teeth 8*d* for driving a second-setting lever as shown in FIG. 2. A resilient member 8*c* urges shaft 8 toward winding stem 2 and positions it for multi-stage operation by means of socket 2*e* and wall 2*f* of the winding stem 2. This construction is applicable to the setting mechanism of a calendar watch as well as the mechanism of a watch without a calendar. As in the other embodiments, a setting lever 3, clutch lever 6 and setting wheel 5 are arranged on the opposite side of winding stem 2 from dial 21.

Figure 4A:
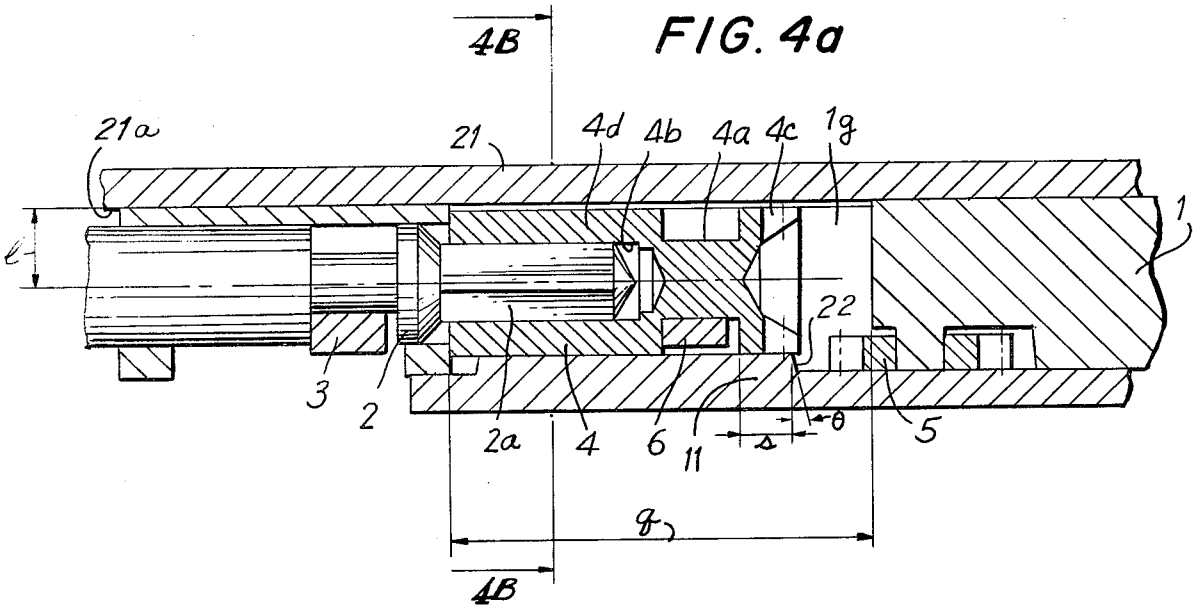
FIGS. 4*a* and 4*b* are, respectively, lengthwise and transverse cross-sectional views of a setting mechanism in accordance with a fourth embodiment of the present invention.
Figure 4B:
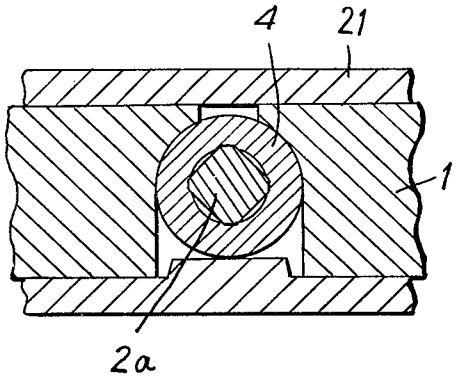

FIGS. 4*a* and 4*b* are respectively longitudinal and transverse cross-sectional views of a fourth embodiment of a setting mechanism in accordance with the present invention. Main plate 1 and auxiliary plate 11 form a region 1*g* therebetween for supporting clutch wheel 4 for rotation and for axial translation, support being by way of the exterior or maximum diameter surface of said clutch wheel. The axial length q of portion 1*g* allows for variation in the maximum axial movement of clutch wheel 4. At that time of hand-setting, clutch wheel 4 is moved to the position in which it engages setting wheel 5 by means of teeth 4*c*. At that time, the length s for rotatably supporting clutch wheel 4 is different from zero. Winding stem 2 has no interior socket corresponding to the embodiment of FIG. 3, and clutch wheel 4 has no rotatably supported portion 4*d* of the type shown in FIG. 2. The other elements of the embodiment of FIG. 4*a*, including main plate 1, setting lever 3, setting wheel 5, clutch lever 6 and dial 21, are the same as in the embodiments of FIGS. 2 and 3*a*.

Setting wheel 5 of FIGS. 2, 3*a*, 3*b* and 4*a* is rotatably supported by the pin provided on the main plate 1 or auxiliary plate 9. The clutch wheel 4 is preferably of one piece. However, the rotatably supported portion 4*d*, the portion contained the groove 4*a* and the toothed portion 4*c* may be made separately and then bonded together. Again, it is of paramount importance that levers 3 and 6 and setting wheel 5 are on the opposite side of winding stem 2 from dial plate 21. A further point with respect to the embodiment of FIG. 4*a* is that the socket 4*b* in clutch wheel 4 is blind and terminates short of groove 4*a*. In other words, the socket does not continue into the grooved portion of clutch wheel 4.

As a result of this construction, the length 1 between the lower surface 21*a* of the dial and the shaft of the winding stem can be minimized. Accordingly, considering the case of a wristwatch having an over-all thickness of 5 mm, the length between the upper surface of the glass and the center axis of the winding stem is 2.6 mm, which is the ideal value for a thin watch. Moreover, it is also important to secure the support of clutch wheel 4 and to enlarge the applicable range of the present invention by making the clutch wheel engage with the lever or the gear train for correction and adjustment.

In FIG. 2, the inclination of clutch wheel 4 at the time of hand-setting becomes smaller than that in the conventional wristwatch and the rumbling or grating feeling which is felt by the fingertips during the operation of hand-setting can be almost completely removed merely by making the play between the engaging portion 2a and the socket 4b to be the same as or a little less than the play between the portion 2b and the rotatably supported portion 4d. Furthermore, in FIG. 4a, the length s for rotatably supporting the clutch wheel 4 may be zero. In fact, the length may be regarded as less than zero, depending upon the extent of overhang of gear portion 4c over the shoulder 22. For optimum operation of clutch wheel 4, angle $\theta$ of the inclined plane surface of plate 11 to a plane perpendicular to the axis of winding stem 2 should be at least 30 degrees.

FIG. 4b is a section through the engaging portion 2a of winding stem 2 and the mating portion of clutch wheel 4 in FIG. 4a. As can be seen, the engaging portion 2a can mate with the clutch wheel 4 by means of the edges formed by the intersections of the flat surfaces of the engaging portion, said edges seating in corresponding notches or grooves in the side walls of the socket 4b.

It will thus be seen that the objects set forth above, among those made apparent from the preceding description, are efficiently attained, and since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A setting mechanism of a watch comprising a dial plate, a winding stem interior to said dial plate and essentially parallel thereto, frame plate means for supporting said winding stem for rotation and for axial translation, clutch wheel means coaxially mounted on said stem and movable therewith, and a member actuatable in response to axial movement of said clutch wheel means, a first portion of said winding stem within said clutch wheel having a first cross-section for mating with said clutch wheel means for rotating said clutch wheel means with rotation of said winding stem and moving said clutch wheel means in an axial direction, said clutch wheel means having an engaging annular groove around the outside surface thereof for engaging therein said member and moving said member in said axial direction, said groove being in registry with a second portion of said winding stem within said clutch wheel, said second portion of said winding stem having a second cross-section, the maximum distance in said second cross-section from the stem axis of rotation to said clutch wheel being less than the maximum distance in said first cross-section from said axis to said clutch wheel, whereby said groove can extend inwardly closer to said axis and the watch can be thinner.

2. The setting mechanism as defined in claim 1, wherein said engaging groove is an annular groove around said clutch wheel means and said member is engaged by a side wall of said groove for being moved thereby in a direction parallel to the axis of said winding stem.

3. The setting mechanism as defined in either of claims 1 or 2, wherein said member is engaged by said engaging groove at a portion of said engaging groove on the opposite side of said winding stem from said dial plate.

4. The setting mechanism as defined in claim 1, wherein said clutch wheel means further includes first engaging means at one end thereof, said setting mechanism further comprising setting wheel means rotatable by said first engaging means by combined axial and rotational movement of said winding stem.

5. The setting mechanism as defined in claim 4, wherein said clutch wheel means is unitary in construction.

6. The setting mechanism as defined in claim 4, wherein said clutch wheel means comprises bonded-together sections, the sections being, a section in registry with said first portion of said stem, said engaging groove and said first engaging means.

7. The setting mechanism as defined in claim 4, further comprising support plate means arranged and constructed for supporting said clutch wheel means during axial movement for bringing into engagement said first engaging means and said setting wheel means, said support plate means including a shoulder traversable by said first engaging means, said shoulder making an angle of at least 30 degrees with a plane perpendicular to the axis of said winding stem.

8. The setting mechanism as defined in claim 4, wherein said member and said setting wheel means are disposed on the opposite side of said winding stem from said dial plate.

9. The setting mechanism as defined in claim 1, wherein said first stem portion has a side surface, a portion of said side surface being flat, and said clutch wheel is arranged and constructed for mating with said flat when said first stem portion is introduced thereinto and bringing said clutch wheel means into rotation in response to rotation of said winding stem.

10. The setting mechanism as defined in claim 9, wherein said first stem portion is essentially square in section perpendicular to the axis thereof.

11. The setting mechanism as defined in claims 4 or 8, further comprising second engaging means around a third portion of said stem and setting lever means engaged therewith, said setting lever means being disposed on the opposite side of said winding stem from said dial plate.

12. A setting mechanism of a watch, comprising:

a dial plate;

a winding stem interior to said dial plate and essentially parallel thereto, said winding stem comprising, in longitudinal sequence, a first portion of a first cross-section and a second portion of a second cross-section, said stem portions being coaxial;

frame plate means for supporting said winding stem for rotation and for axial translation;

a member actuatable in response to axial movement of said winding stem, a setting wheel means mounted rotatably on said frame plate; and clutch wheel means coaxially mounted on said stem and having two ends, one of said ends for mating with said first stem portion, a portion between said ends for supporting said clutch wheel means rotatably on said second stem portion, an engaging annular groove between said ends for engaging said member, and first engaging means at said other end for engaging said setting wheel means, said one end of said clutch wheel means and first stem portion being shaped for permitting entry of said first stem portion into said one end and for thereby joining to each other for cojoint rotation when said winding stem is rotated, said groove being in registry with said second portion of said winding stem, the maximum distance in said second cross-section from the stem axis of rotation to said clutch wheel being less than the maximum distance in said first cross-section from said axis to said clutch wheel, whereby said groove can extend inwardly closer to said axis and the watch can be thinner.

13. The setting mechanism as defined in claim 12, wherein said engaging groove is an annular groove about said support section and said member is engaged by a side wall of said groove for being moved thereby in a direction parallel to the axis of said winding stem.

14. The setting mechanism as defined in claim 12, further comprising a stem base portion setting lever means and second engaging means about said base portion for moving said setting lever means in said axial direction, said member, said setting lever means and said setting wheel being disposed on the opposite side of said winding stem from said dial plate.

15. The setting mechanism as defined in claim 12, wherein said first stem portion has a flat surface thereon and said one end of said clutch wheel is shaped for mating with said flat surface.

16. A setting mechanism of a watch, comprising:

a dial plate;

a winding stem interior to said dial plate and essentially parallel thereto, said winding stem comprising a connecting portion of a first cross-section, said connection portion being the inner end of said winding stem and having an axial socket therein;

main plate means for supporting said winding stem for rotation and for axial translation;

shaft means having a first end seatable in said stem socket and a second end, said second end having a flange thereon, said main plate means having therein a semi-annular groove for receiving said flange, and an axial half-groove for supporting said shaft means;

auxiliary plate means bonded to said main plate means for cooperating therewith in supporting said shaft means and having therein a semi-annular groove and a half-groove corresponding to those in said main plate means;

setting wheel means rotatably supported on said auxiliary plate means;

clutch wheel means coaxially supported for rotation and axial translation on said shaft means; and a member actuatable in response to said axial translation of said clutch wheel means, said clutch wheel means having a first end having a socket therein for receiving therein said connecting portion, a support portion for supporting said clutch wheel means on said shaft means, an engaging annular groove about said support means for actuating said member, and a second end having thereon first engaging means for actuating said setting wheel, said member and said setting wheel being disposed on the opposite side of said winding stem from said dial plate and said engaging groove being in registry with a second cross-section of said shaft means beyond said socket, the maximum distance in said second cross-section from the axis of rotation to said clutch wheel means being less than the maximum distance in said first cross-section from said axis to said clutch wheel means, whereby said groove can extend inwardly closer to said axis and the watch can be thinner.

17. The setting mechanism as defined in claim 16, wherein said shaft means is fixed to at least one of said main plate means and said auxiliary plate means to prevent relative movement.

18. The setting mechanism as defined in claim 16, wherein said flange has thereon second engaging means for actuating and said shaft means and connecting portion socket have mateable surfaces for bringing said shaft means into rotation in response to rotation of said winding stem.

19. A setting mechanism of a watch, comprising a dial plate, a winding stem interior to said dial plate and essentially parallel thereto, frame plate means for supporting said winding stem for rotation and for axial translation, clutch wheel means coaxially mounted on said stem and movable rotationally and axially therewith, and a member actuatable in response to axial movement of said clutch wheel means, a portion of said clutch wheel means extending axially beyond the end of said stem, said clutch wheel means having an engaging annular groove around the outside surface thereof for engaging therein said member and moving said member in said axial direction, said groove being formed in said portion of said clutch wheel means extended beyond said end of said stem whereby the distance from the axis of rotation to said groove can be less than the maximum distance in said stem from said axis of rotation to said clutch wheel, whereby said groove can extend inwardly closer to said axis and the watch can be thinner.

* * * * *